US005291951A

United States Patent [19]

Morand

[11] Patent Number: 5,291,951

[45] Date of Patent: Mar. 8, 1994

[54] COMPRESSED AIR FOAM PUMP APPARATUS

[75] Inventor: James W. Morand, Wallsbury, Utah

[73] Assignee: Utah La Grange, Inc., Orem, Utah

[21] Appl. No.: 998,120

[22] Filed: Dec. 28, 1992

[51] Int. Cl.[5] ..... A62C 5/02

[52] U.S. Cl. ..... 169/14; 169/44

[58] Field of Search ....., 169/14, 15, 44, 13

[56] References Cited

U.S. PATENT DOCUMENTS

| | | | |
|---|---|---|---|
| 4,345,654 | 8/1982 | Carr | 169/14 X |
| 4,981,178 | 1/1991 | Bundy | 169/15 X |
| 5,096,389 | 3/1992 | Grady | 169/14 X |
| 5,113,945 | 5/1992 | Cable | 169/14 X |
| 5,145,014 | 9/1992 | Eberhardt | 169/14 |

*Primary Examiner*—David M. Mitchell
*Assistant Examiner*—Gary C. Hoge
*Attorney, Agent, or Firm*—Workman, Nydegger & Jensen

[57] ABSTRACT

Fire fighting apparatus for generating air compressed foam having both a water and a surfactant metering device for dispensing controlled and discrete quantities of both into a mixing conduit where they combine into a foam solution. The foam solution is combined with air prior to being injected within a compression chamber of an air compressor device. Foam is generated by compression of the air-foam solution and then is discharged through a discharge device. The air compression device is also controlled to dispense a discrete quantity of foam therefrom in correlation with the discrete quantities dispensed from the other two metering devices. The quantitative dispensing coordination of the air compression device with the two metering devices makes all three devices both relational and proportional in the cooperative generation of compressed air foam, and thus ensures prompt production of constant quality foam. The relational and proportional condition is achieved in a preferred mechanical embodiment by incorporating a common, concentric drive shaft driving all three dispensing devices, each of which is a rotary vane pump. In an electrical embodiment, the relational and proportional condition is achieved by an electric drive motor driving each dispensing device at a pre-set R.P.M., each motor being, connected to and controlled by a programmable control device Mechanical and electrical embodiments have devices for monitoring and controlling a variety of operational parameters to further enable prompt production of constant quality air compressed foam.

38 Claims, 7 Drawing Sheets

COMPRESSED AIR FOAM PUMP APPARATUS

BACKGROUND

1. Field of the Invention

The present invention relates to an apparatus for delivering a compressed air foam. More particularly, the present invention relates to an apparatus which allows for proportionate and precise amounts of fluid and a foaming agent surfactant to be mixed and compressed with air thereby producing foam, and where the amounts of fluid, foaming agent, air and other variables may be independently varied so as to result in the generation of a preselected consistency of foam.

2. Background Art

Compressed air foam delivery systems are commonly used for fire fighting applications. These systems are known in the art as "water expansion pumping systems" (WEPS) and "compressed air foam systems" (CAFS). Typically, these systems will include a water pump device, a device for injecting a foaming agent surfactant, and an air compression device. Foam is generated by mixing the water and the foaming agent surfactant together to create a foam solution and then agitating the mixture with compressed air. The site of actual foam generation varies among systems, but generally occurs in a hose or discharge device, or in a specially designed delivery nozzle.

There are various distinct types of foam recognized for fire fighting applications, each of which vary in their concentrations of water, air and foaming agent surfactant. These classes of foam each demonstrate different characteristics, including drainage rate, electrical conductivity, and degree of wetness or dryness. The characteristics of a foam therefore have an effect on both its ability to prevent or suppress fire and on fire fighter safety during generation and use.

Other factors will also dictate the quality and consistency of the foam generated, including the temperature of the water, the temperature of the foaming agent surfactant (or surfactant), the outside or ambient air temperature, the type of surfactant used, and the type of water used (e.g., salt water is a better foaming agent than non-salt water, depending on the surfactant).

As stated, most foam fire extinguishing systems currently in use produce foam within an unrolled fire hose accompanying such systems. The problem with such an arrangement is that a need for a fire extinguishing foam cannot be met until the fire hose is first unrolled and then the foam is subsequently produced within the hose, the process of which can be a time consuming affair. As time is of the essence in fire fighting situations, this problem is particularly acute.

Another substantial drawback of currently available compressed air foam generation systems is that they are unable to quickly alter the type of foam that is generated, based either upon the type of surfactant used and/or the aforementioned external variables. Often, especially in fire fighting applications, a specific application will require that a particular type of foam be generated. For instance, in fire fighting, certain classes of foam may only be used for chemical fires, while others are more suitable for structural fires. Thus, prior art compressed air foam generation systems are typically designed for a specific purpose, and consequently will generate only foam suitable for that, and only that, specific application. These prior art systems make it difficult, if not impossible, to alter the type of foam that is generated, especially on a "real-time" basis. Systems of this type are thus not suitable for those applications that require, or benefit from, the selective generation of different types of foams.

An additional disadvantage of prior art foam generation systems is that they are unable to quickly respond to changing external factors. For instance, air temperature and humidity, the type of fire to be extinguished, the type of surfactant available, or the type of water that is available will rarely be constant. Thus, foam quality will vary unless the system provides for a method of compensating for these variables, a feature heretofore unavailable in foam delivery systems.

Additionally, the pressure at which the compressor delivers the air foam is also dependent on a variety of factors. Hose length, hose diameter and the inclination of the hose—uphill, level or downhill—are all factors affecting delivery pressure requirements. At the same time, although delivery pressure may vary, foam quality must remain constant. Again, prior art systems are lacking in that they are unable to respond quickly to these changing variables and simultaneously deliver a foam of a particular and consistent quality. Thus, they operate effectively only under specific and non-varying conditions.

OBJECTS OF THE INVENTION

It is therefore a primary object of the present invention to provide a compressed air foam pump apparatus that is able to quickly generate acceptable quality foam, while avoiding the delays inherent in foam generating systems that generate foam within the fire hose that is used to deliver the foam produced therein to a fire.

It is also an important object of the present invention to provide a compressed air foam pump apparatus that is able to mix fluid, a foaming agent surfactant and air in precise proportions, and which then subjects the mixture with air to pressure thereby producing a compressed air foam of a consistent and predetermined quality.

It is an additional object of the present invention to provide a compressed air foam pump apparatus in which the foam quality can be quickly altered by allowing the operator to continuously vary the ratio of foaming agent surfactant to fluid during the operation of the pump apparatus.

It is also an object of the present invention to provide a compressed air foam pump apparatus that is capable of utilizing a variety of different foaming agent surfactants by automatically calculating a base line ratio of foaming agent surfactant to fluid.

It is also an object of the present invention to provide a compressed air foam pump apparatus that enables the pump operator to continuously monitor the quality of the compressed air foam that is being produced by monitoring a variety of operating characteristics, including temperatures, operating pressures, foam electric conductivity, and the generated pressures of the fluid, foaming agent surfactant and compressed air foam.

It is a further object of the present invention to provide a compressed air foam pump apparatus that automatically maintains the operating temperature of the foaming agent surfactant and the fluid within an ideal temperature range so as to further insure and control the quality of the compressed air foam that is produced.

It is yet another object of the present invention to provide a compressed air foam pump apparatus that automatically calculates the appropriate discharge pressure of the compressed air foam, depending on the length and circumference of the delivery hose and also depending on whether the delivery hose is oriented in an uphill, downhill, or level fashion.

It is yet another object of the present invention to provide a compressed air foam pump apparatus that will halt the production of foam in response to the discharge device being closed off from discharging foam so that any resumed generation and discharge of foam will be even in consistency, e.g. being free of slugs of fluid or air.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

BRIEF SUMMARY OF THE INVENTION

To achieve the foregoing objects, and in accordance with the invention as embodied and broadly described herein comprises a compressed air foam pump apparatus. The apparatus includes a novel combination of a device for delivering and metering a fluid such as water, a device for delivering and metering a foaming agent surfactant, and an air compressor device for metering, injecting, mixing and compressing the resultant foam solution mixture with air, and thereby producing an air-foam mixture that is ejected from the system under pressure. The metering of each of the fluid, the foaming agent surfactant and the combination of these with air is preferably relational and proportional. To do this, the fluid metering device, the foaming agent surfactant metering device, and the air compressor device are preferably all driven by a common power transmission means, such as a single drive shaft, a single endless chain or belt, or by separate drive means each of which is controlled by a common programmable control means (such as a personal computer).

In one preferred embodiment of the invention, a motor is utilized to drive a drive shaft. The motor can be any kind of available drive system—such as a diesel engine, hydraulic drive or an electric motor—as long as it supplies sufficient power to rotate the drive shaft. By way of example and not by way of limitation, a high volume and pressure fluid source can be used to turn a plurality of vanes positioned normally about the longitudinal axis of the drive shaft such that the vanes move under the influence of the pressure of the fluid, and the vanes in turn cause the drive shaft to revolve about its longitudinal axis. Regardless of what type of drive shaft drive means that is used, as the drive shaft revolves it simultaneously drives the operation of the fluid metering device, the foaming agent surfactant metering device and the air compressor device.

In a preferred embodiment, a fluid, such as water, is delivered to the fluid metering means from a fluid source under pressure via a fluid conduit. Preferably, this fluid conduit contains a filtration device that filters out any impurities that may be in the fluid and then vents them out via the filter's fluid exhaust outlet. The filtered fluid then proceeds through the fluid conduit to the injection port of the first metering device and so the fluid is both metered and pumped therefrom.

This first metering means is preferably of the type commonly referred to as a rotary vane pump. As mentioned, this rotary vane pump is being driven by a drive shaft. Thus, for every revolution of the drive shaft, a predetermined volume of fluid is taken from the fluid conduit at the rotary vane pump injection port and pumped through to its discharge port. Connected to the discharge port is a second fluid conduit.

Also being driven by the drive shaft is a second metering means. This second metering means is also preferably a rotary vane pump device. Connected at this rotary vane pump's injection port is a foaming agent surfactant source. Thus, for every revolution of the drive shaft, an exact amount of the foaming agent surfactant is delivered out of the pump's discharge port. This discharge port is in turn connected to the second fluid conduit, as is the first metering means discharge port, such that the foaming agent surfactant is ultimately commingled and mixed with the fluid metered through the first metering means to produce a foam solution mixture.

The second fluid conduit then delivers the foam solution mixture to an injection port of the air compressor means. The air compressor means is also preferably a rotary vane pump and is also being driven by the same drive shaft. The rotary vane pumps of the first and second metering means preferably have evenly spaced vanes about their respective rotors, each rotor being centered within a circular chamber. The rotary vane pump preferred for the air compressor means has a least one vane about its rotor, and should the compressor embodiment have a plurality of such rotary vanes, they are to be evenly spaced vanes about the rotor. In the preferred air compressor, the rotor is to be offset from the center of its chamber so as to create compression between the vane surfaces during revolution about the air compressor rotor. The chamber may be circular, oblong or egg shaped, or of equivalent shape. Equivalent means to the rotary vane air compressor are also contemplated for the present invention, such as screw-type air compressors, the key feature of such equivalents being that they both meter and compress the air-foam solution being pumped therethrough. Also, equivalent structures for the first and second metering means function are also contemplated for the present invention, the key feature of such equivalents being that can meter substances being pumped therethrough.

The present invention also contemplates using a solid surfactant as opposed to a liquid foaming agent surfactant. For example, the second metering means may optionally comprise a rotating auger means rotating under power transmitted from the aforementioned common drive shaft. The auger means, with each revolution of the drive shaft, meters a discrete quantity of surfactant into the second fluid conduit. In such an auger means arrangement, the surfactant could be either a liquid or a solid surfactant.

The air compressor means has a second injection port solution mixture prior to being subjected to compression. Since the air must be mixed with the foam solution mixture prior to compression, it is preferably that the first and second injection ports to the air compressor be the same. Once mixed in a common conduit, the combined air and foam solution mixture are then subjected to compression within the air compressor resulting in generated foam. The generated foam is then discharged or ejected under pressure through the compressor's discharge port. A hose or other discharge device is typically connected to the discharge port, which is used to deliver the pressurized air-foam stream.

Preferably, a heat sink is disposed in thermal contact with the second fluid conduit in order to transfer heat generated from the air compressor. This heat sink may be encased as a water jacket around the air compressor such that heat generated by the air compressor is absorbed by the heat sink. The heat sink in turn transfers heat to the fluid (or the fluid-surfactant mixture, depending on both the desired routing of these and the desired positioning of the water jacket heat sink) passing through the second fluid conduit. Thus, at the point where the second fluid conduit exits the heat sink, the fluid (or fluid-surfactant mixture) temperature is increased prior to it being delivered to the injection port of the air compressor. This configuration provides two benefits. First, the air compressor is kept at a sufficiently cool operating temperature by the water jacket heat sink. Secondly, the heated fluid-surfactant mixture allows for a higher quality air-foam to be produced in that higher temperatures enable more foaming agent surfactant to dissolve within the fluid of the resultant foam solution.

Alternatively, a water jacket heat sink may be replaced with another type of heat sink. One example of an equivalent heat sink is a cooling fins arrangement, positioned so as to take heat off the air compressor, in which case the fins themselves (or a separate thermal generation means) could be used to pre-heat the foam solution mixture or the fluid (depending on the configuration thereof).

Because of the common drive shaft and the operating characteristics of the rotary vane pumps, each revolution of the drive shaft will result in a precise amount of air-foam to be discharged from the system. Equally important, the air-foam is comprised of a precise ratio of air, foaming agent surfactant and fluid, because each revolution of the drive shaft will meter precise amounts of each substance through the respective metering device. Thus, air-foam will be instantaneously generated by the apparatus. Also, the air-foam that is generated will be of single and consistent type, and will remain so throughout a wide range of operating levels dictated by the operating speed of the drive shaft.

In addition, the air compressor rotary vane pump does not require oil to seal and lubricate the vanes, as is typically required. Rather, the foam solution mixture acts as both a lubricant and a sealant for the air compressor rotary vane pump.

In a second preferred embodiment of the present invention, adjustable valves are placed proximal to the discharge ports of the fluid metering device and the foaming agent surfactant metering device. By adjusting the openings of these valves, the mixture ratio of fluid to foaming agent surfactant injected into the air compressor pump can be varied. In this way, the operator of the apparatus can alter the consistency and quality of the foam being produced.

Preferably, the valves are adjustable electrically in relation to varying of the operating voltage supply or the electrical current supply to the valve. In a second preferred embodiment, this control is done via a programmable control means device, which is programmed to either automatically control the valves, or to allow an operator to control the valves via a user operated control panel or input means that is connected to the programmable control means.

In the second preferred embodiment will preferably utilize a variety of sensing devices which provide ongoing operating information to the programmable control means, including pressures and temperatures. The programmable control means is capable of determining appropriate responses to these operating parameters. Possible responses include adjustment of the electrically adjustable valves to accomplish different mixture ratios, adjustment of fluid and/or foaming agent surfactant temperatures by way of electrically controllable heating element devices placed in contact with the fluid and the foaming agent surfactant, and delivery of certain diagnostic information to the operator via an alphanumeric display connected to the programmable control means. The artisan will understand that equivalent components can also be employed to enable the programmable control means to adjust the system, such a pneumatically adjustable valves in place of electrically adjustable valves, and gas combustion heat exchangers in place of the electrically controllable heating element devices.

In both the first and second preferred embodiments, it is desirable to position at the exhaust port of the air compressor means, and the first and second metering means, a pressure sensing and response means. Each such means for sensing and responding are to communicate signals proportional to the pressure sensed to a means for controlling the transmitted drive power to the drive shaft so that the drive shaft may be either engaged or disengaged depending on performance of the foam generating apparatus, as indicated by the pressures sensed. These features are particularly of significance when the fluid or surfactant sources have been depleted, during system start-up, when the hose or discharge device is temporarily shut-off by a system user, or when there are system malfunctions occurring which necessitate a system shut down.

In a third preferred embodiment of the present invention, the requirement for the common drive shaft is eliminated. In the third embodiment, the first metering means, the second metering means and the air compressor are each driven by a separate controllable drive motor. These drive motors each individually operate the associated metering device and air compressor device and are each controlled via electric signals generated by the programmable control means. Thus, in this embodiment, each metering device would be operated individually and independent of the other. Since the amount of fluid that is metered through each device is dependent on its operating speed (e.g. the number of revolutions of its rotor), this embodiment provides the capability to independently vary the amount of fluid and the amount of foaming agent surfactant that is metered through the first and second metering devices that is then fed into the air compressor, thus allowing for the production of different foam qualities. Similarly, the amount and pressure of air-foam that is discharged from the air compressor is also dependent on its operating speed and is thus controllable via the operation of its separate drive motor.

The third embodiment also utilizes the various electro-mechanical devices already discussed for monitoring and controlling various system parameters. Again, these devices will be positioned so as to monitor critical pressures, temperatures, R.P.M. of the various drive means, and external parameters so that the operator, or the programmable control means, may make appropriate system adjustments and thus selectively generate and maintain a desired quality of foam.

Thus, in the third embodiment there is a fluid delivery means, which can be any device that supplies water (or other suitable fluid) from a source. This fluid is then output to a fluid conduit. A filtration device may be positioned (if desired) after the valve to filter out any impurities that may be in the fluid and vents them out via the a fluid exhaust port associated with the filter. The fluid then proceeds through the fluid conduit, which is connected downstream to the injection port of the first metering means.

This first metering means is preferably a rotary vane pump. As mentioned, in the third embodiment the rotary vane pump is driven by an independent and controllable drive means, such as a controllable dc motor. The drive means is controlled by electronic signals and the drive means in turn rotates the rotor of the rotary vane pump. Thus, for every revolution of the rotor, a predetermined volume of fluid is taken from the fluid conduit at the rotary vane pump injection port and pumped through to the discharge port. Connected to the discharge port is a second fluid conduit.

A portion of the second fluid conduit comprises a heat sink. The heat sink is encased as a water jacket around the air compressor such that heat generated by the air compressor is absorbed by the heat sink. The heat sink in turn transfers heat to the fluid (or the foam solution mixture) passing through the second fluid conduit. Thus, at the point where the second fluid conduit exits the heat sink, the temperature of the substances therein is increased.

Also being driven by the drive shaft is a second metering means. This second metering means is also preferably a rotary vane pump device. Connected at this rotary vane pump's injection port is a surfactant source. Thus, for every revolution of the drive shaft, an exact amount of the surfactant is delivered out of the pump's discharge port. This discharge port is in turn connected to the second fluid conduit so that the foaming agent surfactant (also called surfactant) is commingled and mixed with the heated fluid. The surfactant and fluid are preferably mixed first before the resultant foam solution mixture is passed around the air compressor through the water jacket heat sink portion of the second fluid conduit.

The second fluid conduit, at a point downstream of where the fluid and surfactant are mixed, is connected to an injection port of the air compressor means. The air compressor is also preferably a rotary vane pump and is also driven by the aforementioned drive shaft. The rotary vane pump air compressor also has a second injection port through which air is introduced. The second injection port is preferably the same as the first injection port to the air compressor. The air is pressurized and mixed with the foam solution mixture, thereby producing a compressed air-foam. The compressed air-foam is then discharged through the discharge port of the air compressor rotary vane pump which is connected to a discharge device (e.g. hose). The discharge device is in turn used to deliver the pressurized air-foam stream.

In a preferred embodiment, the pressured air-foam produced has a relative ratio of one percent of foaming agent surfactant to one gallon of fluid to one cubic foot of air.

An aspect of the second and third embodiments is the inclusion of a programmable control means, such as any one of a number of industry standard microprocessors. This programmable control means device will be interfaced to the all of the controllable drive motors and electro-mechanical devices previously mentioned, as well as to a system user interface to accept input from and output diagnostics to the system user, so as to the objective responsive foam production according to specifications input by a system user.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
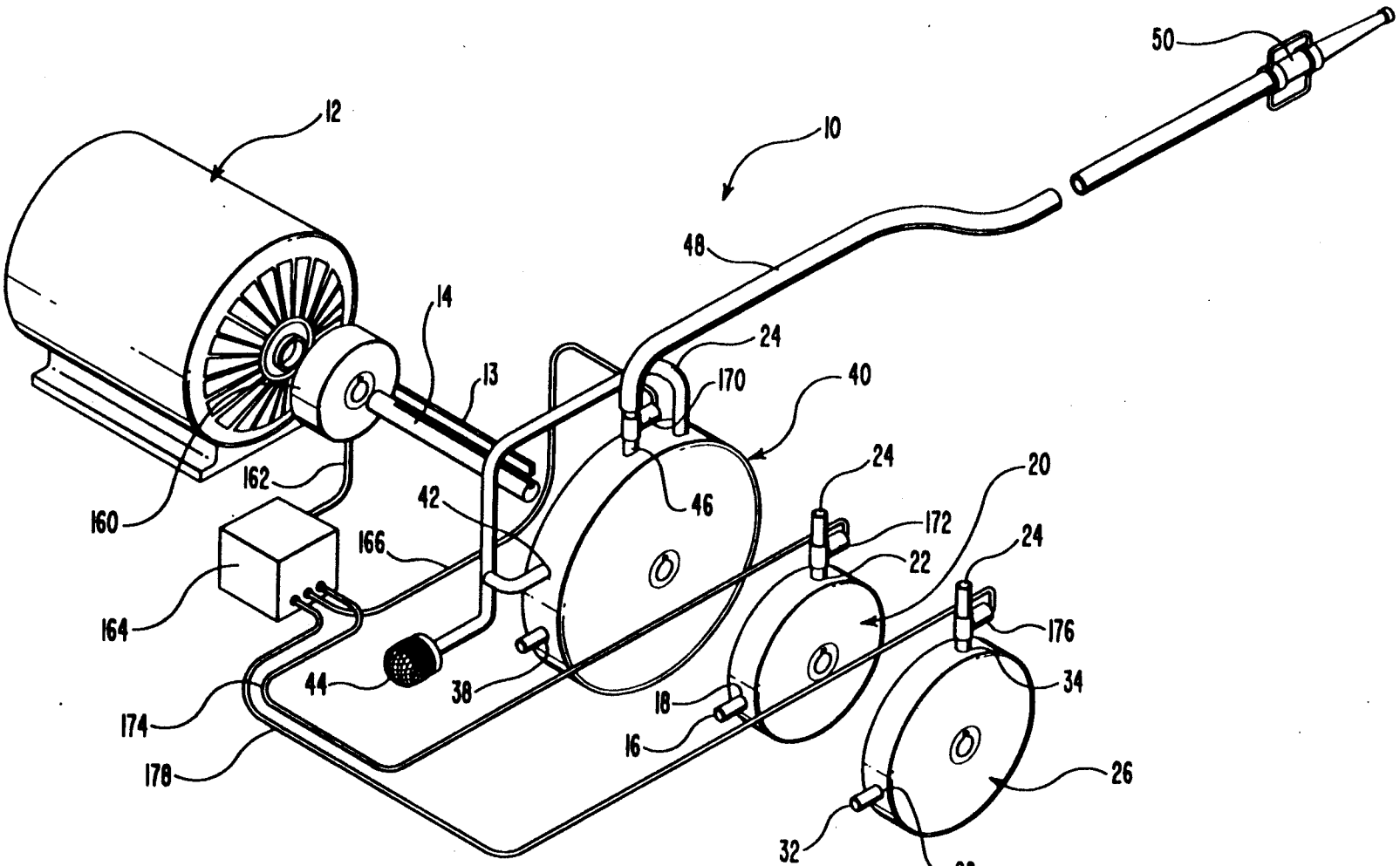
FIG. 1 is a fragmented perspective view of a first embodiment of compressed air foam apparatus.

Reference is now made to the drawings wherein like parts are designated with like numerals throughout. Referring to FIGS. 1, 2, 3 and 7, the presently preferred embodiments of the present invention are illustrated and designated generally at 10.

The compressed air foam apparatus 10 includes a drive means 12 which operates to rotate a drive shaft 14 which extends from the drive means 12. The drive means 12 can be of any type, including a d.c. motor, a diesel or gasoline operated engine, or hydraulic drive.

A means for delivering fluid (such as water) from a fluid source 15 to the compressed air foam apparatus 10 is required. Alternatively and in place of fluid source 15, the fluid delivery means can be of any type that supplies fluid under pressure, including a standard fire hydrant or a water pump located on a standard fire engine. The fluid is delivered to the compressed air foam apparatus via a first fluid conduit 16. The first fluid conduit 16 is connected to a first meter injection port 18 located on a first metering means 20. Preferably, the first metering means 20 is a rotary vane pump, but may be of any similar metering type device as will be apparent to one skilled in the art. The first metering means 20 meters a predetermined volume of fluid present in the first fluid conduit 16 to the first meter discharge port 22 with each revolution of the drive shaft 14. Connected to the first meter discharge port 22 is a second fluid conduit 24.

As shown in FIG. 1 and positioned in communication with the first meter discharge port 22 is a first metering means exhaust port pressure sensing and response means 172 with a first metering means exhaust port pressure sensing and response control cable 174 attached thereto. Such a pressure sensing and response means can be mechanical, electrical, or electromechanical, with a function of creating a signal in proportion to the pressure sensed thereat and then communicating that signal to the pressure sensing and response control cable for the purpose discussed below. For example, a mechanical embodiment may be a spring device and the electrical embodiment may be a piezoresistive pressure transducer, while the electromechanical embodiment may be a spring with electrically controlled switching.

Also connected to the drive shaft 14 is second metering means 26, which is also preferably a rotary vane pump. The second metering means 26 has a second meter injection port 28 through which is passed a foaming agent surfactant, accessed from a foaming agent surfactant source 30 (illustrated in FIG. 2) via a foaming agent conduit 32. The second metering means 26 meters a predetermined volume of foaming agent surfactant from the foaming agent surfactant source 30 to the second meter discharge port 34 with each revolution of the drive shaft 14. The second meter discharge port 34 is also then connected to the second fluid conduit 24.

Positioned in communication with the second meter discharge port 34 is a second metering means exhaust port pressure sensing and response means 176 with a second metering means exhaust port pressure sensing and response control cable 178 attached thereto. Such a pressure sensing and response means can be mechanical, electrical, or electromechanical, with a function of creating a signal in proportion to the pressure sensed thereat and then communicating that signal to the pressure sensing and response control cable for the purpose discussed below. For example, the pressure sensor may be a spring device, a piezoresistive pressure transducer, or a spring with electrically controlled switching.

Figure 2:
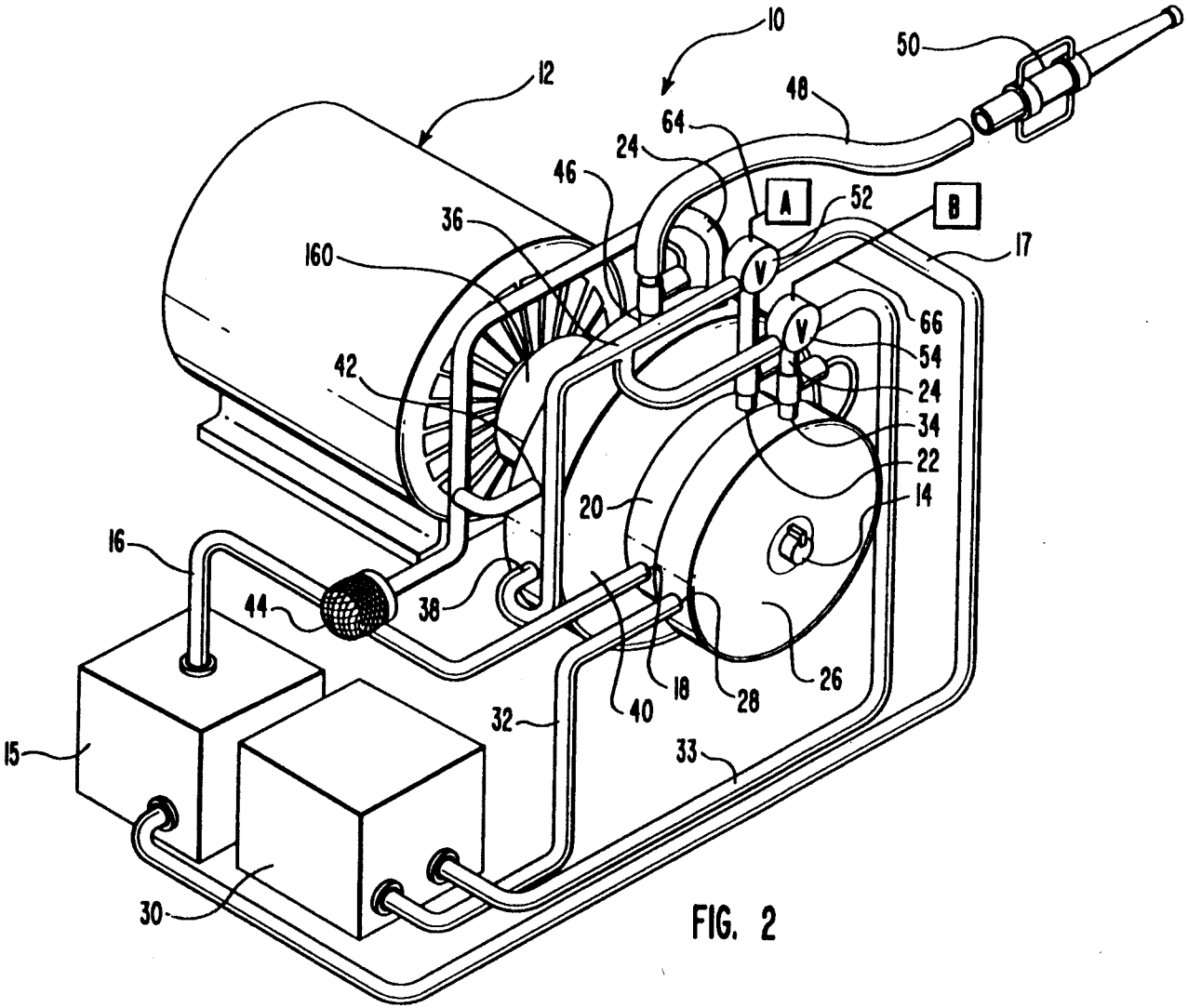
FIG. 2 is a perspective view of a second embodiment of the compressed air foam apparatus.
Figure 7:
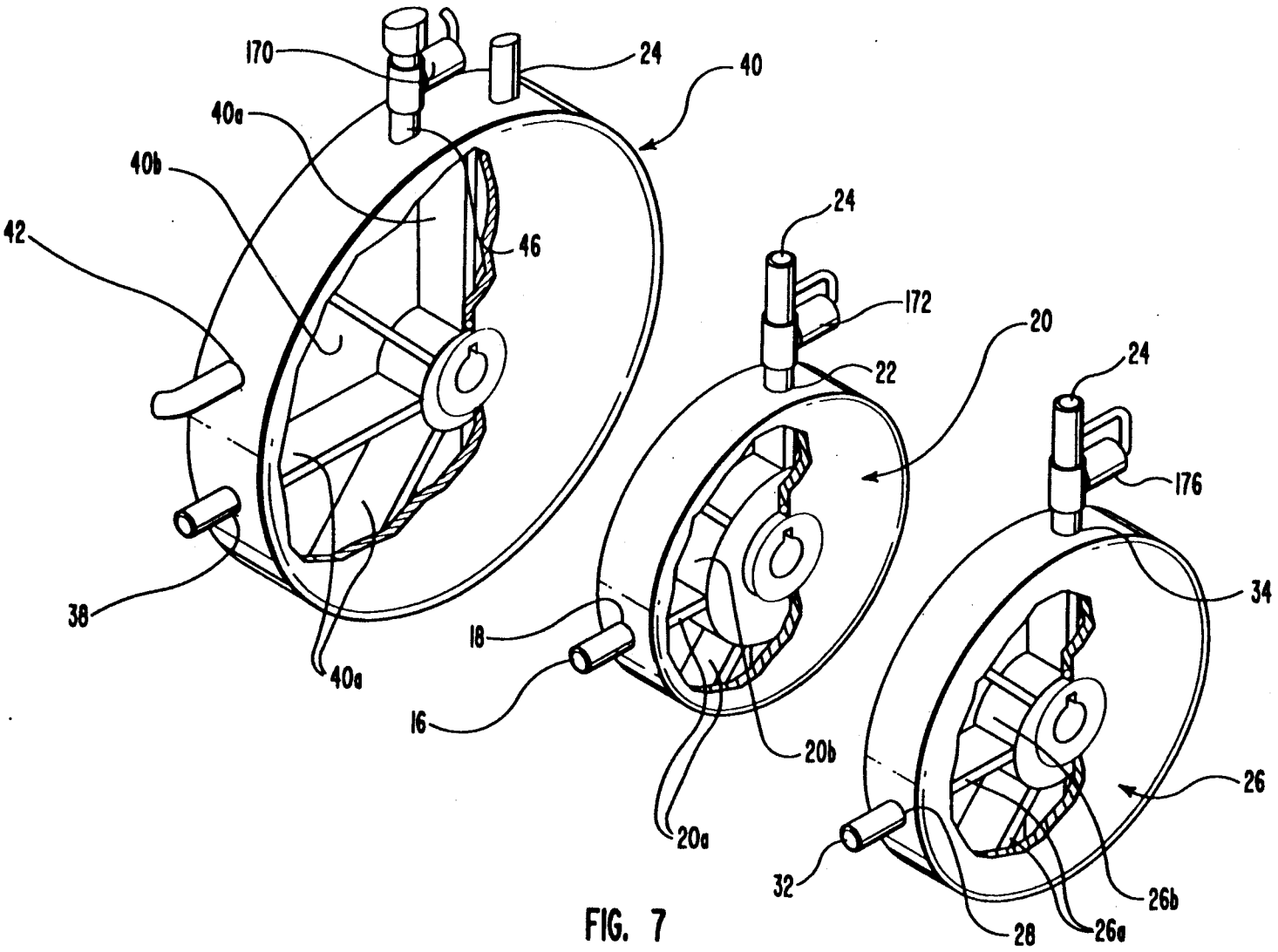
FIG. 7 is a cut-away fragmented perspective view of the first embodiment of compressed air foam apparatus.

With reference now to FIGS. 1, 2 and 7, it is illustrated how the foaming agent surfactant discharged from the second metering means 26 into the second fluid conduit 24 ultimately meets, and is intermixed with, fluid discharged from the first metering means 20 into the second fluid conduit 24. This mixture takes place at a mixture point 36 within the second fluid conduit 24. The second fluid conduit 24 then proceeds to enter a water jacket heat sink 38 which is encased about an air compressor means 40. As the second fluid conduit 24 proceeds through the heat sink 38, the foam solution mixture is heated with the heat absorbed by the heat sink 38 from the air compressor means 40. The second fluid conduit 24 then exits the heat sink 38 and enters the air compressor means 40 at a compressor injection port 42. In communication with the compressor injection port 42 is an air inlet port 44 which is illustrated as having an air filter thereat.

The apparatus illustrated in FIG. 2 operates by the air compressor means 40, also preferably a rotary vane pump compressor, introducing and mixing a predetermined volume of air at the air inlet port 44 and foam solution mixture present at the compressor injection port 42 with each revolution of the drive shaft 14. This predetermined volume of air and of foam solution mixture is then pressurized within the air compressor means 40 thereby producing an air-foam mixture, which is then discharged under pressure out the compressor discharge port 46. Connected to the compressor discharge port 46 is a hose 48 and a nozzle 50 for directing the foam to a fire.

FIGS. 1, 2, and 7 all show a preferred embodiment of the invention in which the drive shaft 14 makes one rotation for every one rotation of each metering device 20, 26, 40. FIG. 7 shows a cut-away of the inside of the metering devices 20, 26, 40 each of which has the same number of rotary vanes, the rotary vanes being mutually aligned in planes normal to the drive shaft 14. Particularly, the air compressor rotary vanes **40*a* form a combination of metering and compression chambers 40*b*. The first and second metering means 20, 26 have respective rotary vanes 20*a*, 26*a* and respective metering chambers 20*b*, 26*b*. The embodiment shown in FIG. 7 features eight (8) metering chambers on each of the metering devices 20, 26, 40. The relative volume differences of metering chambers 20*b*, 26*b*, and 40*b* are a function of the dimensions of the respective metering means 20, 26, 40. In the preferred embodiment shown in FIGS. 1, 2, and 7, the dimensions of each metering means 20, 26, 40 is based upon the intended respective ratios of fluid from fluid source 15, surfactant from surfactant source 30, and air from air source 44. Thus, as the drive shaft 14 makes one revolution, each of the metering means 20, 26, 40 has six (6) respective metering chambers 20*b*, 26*b*, and 40*b* that open to respective discharge ports 22, 34, and 46**.

Positioned in communication with the compressor discharge port 46 is a air compressor means exhaust port pressure sensing and response means 170 with an air compressor means exhaust port pressure sensing and response control cable 166 attached thereto. Such a pressure sensing and response means can be mechanical, electrical, or electromechanical, with a function of creating a signal in proportion to the pressure sensed thereat and then communicating that signal to the pressure sensing and response control cable for the purpose discussed below. For example, the pressure sensor may be a spring device, a piezoresistive pressure transducer, or a spring with electrically controlled switching.

A key 13 fits both into the drive shaft 14 along an axial longitudinal surface thereof and into separate central keyways of the first metering means 20, the second metering means 26, and the air compressor means 40 so as to enable relational and simultaneous revolutions of the respective rotary vanes journaled on the drive shaft 14 within the illustrated meters 20, 26, 40 housings.

The drive shaft 14 is driven by drive means 12 under the control of power transmission means 164 (as seen in FIG. 1 and is hidden in FIG. 2). Power is transmitted to drive shaft 14 from drive means 12 by engaging these two together by clutch means 160. Clutch means 160 is also controlled by power transmission means 164 through transmission control cable 162. The transmission control cable 162 can transmit signals to the clutch 160 that are electrical, mechanical, pneumatic, or the like. The power transmission means 164 has connected thereto the first and second metering means exhaust port pressure sensing and response control cables 174, 178 as well as the air compressor means exhaust port pressure sensing and response control cable 166. The signals from cables 166, 174, 178 enable the drive power taken from drive shaft 14 to be controlled by the power transmission means 164 as a function of the respective signals from pressure sensors 170, 172, 176. Signals sent, as described above for the transmission control cable 62, through these cables set a condition within the power transmission means 164 to engage or to disengage clutch means 160 via clutch cable 162 so as to respectively start or stop the generation of foam. Clutch engagement and disengagement is desirable when the fluid or surfactant supplies have been depleted, when the system is being initialized for start-up, when the hose or discharge device is temporarily shut-off by a system user, or when the system has a malfunction which necessitates a system shut down. For example, when either surfactant or fluid is not being discharged (e.g. due to source depletion) from respective first and second discharge ports 22, 34, the respective first and second metering means exhaust port pressure sensing and response means 172, 176 will so indicate by generating a signal respectively through first and second metering means exhaust port pressure sensing and response control cables 174, 178 to transmission means 164. In turn, transmission means 164 responds to the received signals by transmitting a reaction to clutch cable 162 to disengage clutch means 160 from drive shaft 14. Alternatively, cables 166, 174, and 178 can be wired to switches in series that will open when pressure is detected as less that predetermined pressures at the various pressure sensing means 170, 172 and 176. When any of the switches in series are open, the transmission means 164 is signaled to disengage clutch means 160 as described above. The transmission means 164 must also be able to keep the clutch means 160 engaged during the low pressure conditions occurring at the various pressure sensing means 170, 172, and 176 during system start-up. As one example, the transmission means 164 may be provided with an override switch which overrides all of the aforementioned switches that are wired in series, so that the open status of the series-wired switches during system start-up will not causes the drive shaft 14 to be disengaged from the drive means 12. Once the proper pressures at sensing means 170, 172, and 176 are achieved, the series-wired switches will close and the override switch will open—which switch status will continue during proper system operation. By controlling the transmission of power to the drive shaft 14, the compressed air foam pump apparatus 10 will halt the production compresses air foam in response to the discharge device being closed off by a system user (such as closing off the hose) so that any resumed generation and discharge of foam will be prompt and even in consistency, e.g. being free of slugs of fluid or air.

Figure 3:
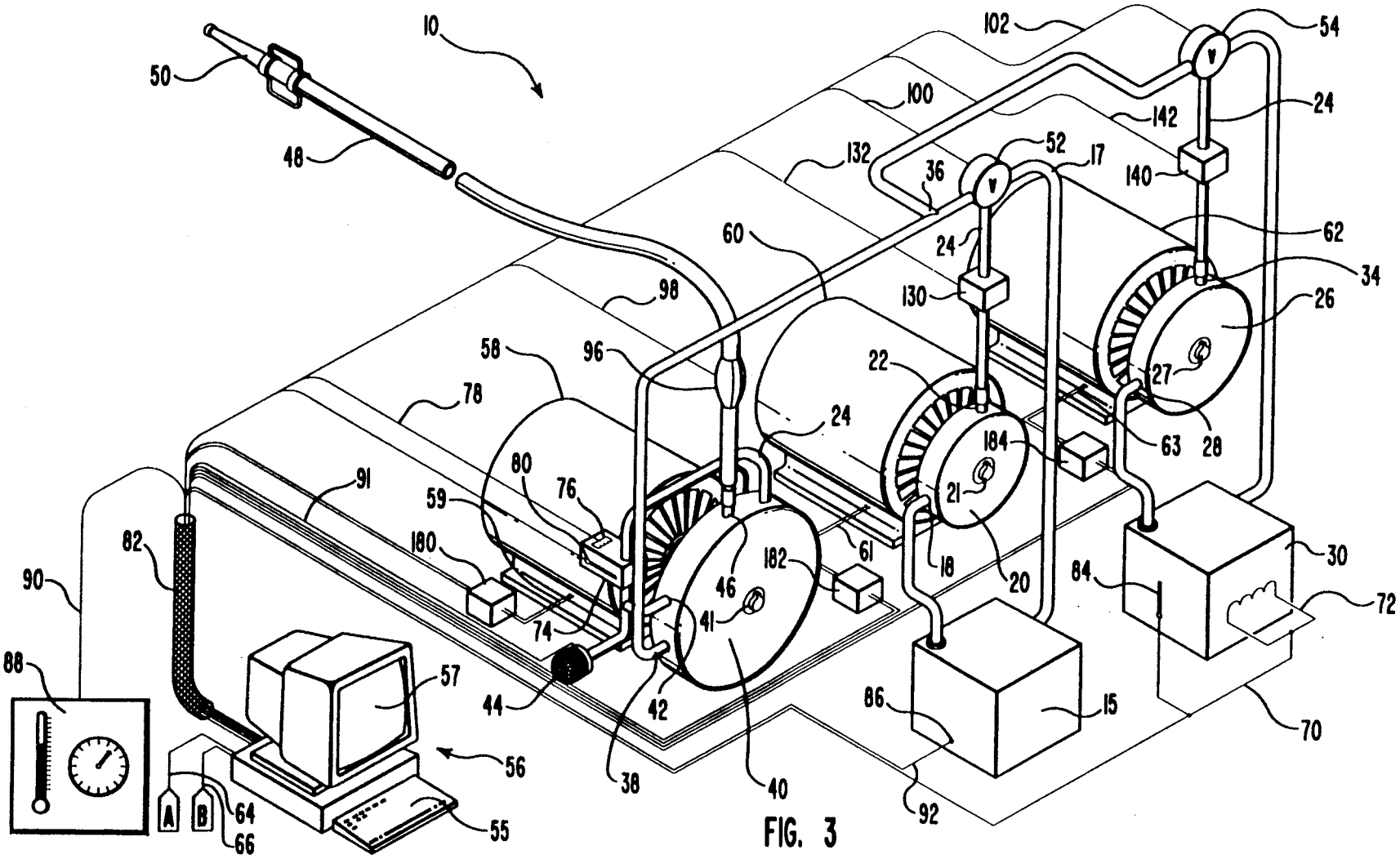
FIG. 3 is a perspective view of a third embodiment of the compressed air foam apparatus.

A second preferred embodiment of the present invention, also illustrated in FIG. 2, functions as the first preferred embodiment but further features a first adjustable valve means 52 which is disposed after the first meter discharge port 22 and within the second fluid conduit 24, as well as a second adjustable valve means 54 disposed after the second meter discharge port 34 and within the second fluid conduit 24. Each of the valves may be adjustable by combined solenoid/relay devices, equivalents thereof, or other devices known to the artisan. Preferably, each of the valves are operable electrically whereby the amount of fluid/surfactant that is allowed to pass through each valve is selectively variable as a function of a variation of the operating input voltage or variation of the electrical current supplied to the valves 52, 54. The excess of substances not passing further into the second fluid conduit 24 through each valve 52, 54 are shunted or passed respectively into exhaust conduits 17, 33. Each valve 52, 54 is independently connected electrically, via respective first and second adjustable valve control cables 64, 66, to a programmable control means 56 in FIG. 3. which preferably comprises a system user input means, such as a keyboard 55, a standard display means 57, and a standard digital microprocessor including data memory means and program memory means. The programmable control means 56 in FIG. 3 is connected to valves 52, 54 by control cables 64, 66, as is illustrated by FIG. 2 by respective off-page connectors A and B. The programmable control means 56, which may be a general purpose microcomputer, is preprogrammed to function as an expert system for proper valve adjustment for fire fighting according to parameters input by a system user at the key board associated with programmable control means 56.

A third preferred embodiment of the present invention is illustrated in FIG. 3. This embodiment of the invention is operates primarily as does the first and second preferred embodiments with the exception that there is no common drive shaft to relate the proportioning of substances through the various rotary vane pumps. Unlike the first and second preferred embodiments, the requirement for the common drive shaft is eliminated. In the third embodiment, the first metering means 20, the second metering means 26 and the air compressor means 40 are each rotary vane pumps respectively having rotors 21, 27, and 41 journaled therethrough, and are respectively driven by separate and controllable drive motors 60, 62, and 58. These drive motors each individually operate the respective rotors 21, 27, 41 of the associated respective metering devices and air compressor device, 20, 26, 40, and are each controlled via electric signals through respective control cables 61, 63, and 59 generated by the programmable control means 56 so that each metering device and air compressor, 20, 26, 40 is operated individually and independent of the other. Independent operation of drive motors 60, 62 provide the capability to independently vary the amount of fluid and the amount of foaming agent surfactant that is metered through the first and second metering devices 20, 26 and fed into the air compressor 40, thus allowing for the production of different foam qualities. Similarly, the amount and pressure of air-foam that is discharged from the air compressor 40 is also dependent on the operating speed and is thus controllable via the operation of its drive motor 58. The air being fed to the air compressor at 44 can also have thereat an air pressure measuring means which feeds a detected air pressure value back to the programmable control means 56 via control cable 91. As in the second preferred embodiment, the third preferred embodiment features adjustable valves 52, 54 that are in communication with the programmable control means 56 respectively by a first adjustable valve control cable 100 and a second adjustable valve control cable 102.

Positioned in communication with the first meter discharge port 22 is a first metering means exhaust port pressure sensing and response means 130 with a first metering means exhaust port pressure sensing and response control cable 132 attached thereto. Such a pressure sensing and response means 130 is preferably electrical, or electromechanical, with a function of creating a signal in proportion to the pressure sensed thereat and then communicating that signal to the pressure sensing and response control cable 132 to programmable control means 56 for the purpose discussed below. For example, the electrical embodiment may be a piezoresistive pressure transducer, while the electromechanical embodiment may be a spring with electrically controlled switching. The first metering means drive means 60 has a first metering means drive means tachometer 182 that measures the R.P.M. of the first metering means 20 and creates a signal in proportion thereto that is sent to programmable control means 56 via control cable 61.

Positioned in communication with the second meter discharge port 34 is a second metering means exhaust port pressure sensing and response means 140 with a second metering means exhaust port pressure sensing and response control cable 142 attached thereto. Such a pressure sensing and response means 140 is preferably electrical, or electromechanical, with a function of creating a signal in proportion to the pressure sensed thereat and then communicating that signal to the pressure sensing and response control cable 142 to programmable control means 56 for the purpose discussed below. For example, the electrical embodiment may be a piezoresistive pressure transducer, while the electromechanical embodiment may be a spring with electrically controlled switching. The second metering means drive means 62 has a second metering means drive means tachometer 184 that measures the R.P.M. of the second metering means 26 and creates a signal in proportion thereto that is sent to programmable control means 56 via control cable 63.

The air compressor means drive means 58 has a air compressor drive means tachometer 180 that measures the R.P.M. of the air compressor means 40 and creates a signal in proportion thereto that is sent to programmable control means 56 via control cable 59.

All of the aforementioned tachometers 180, 182, and 184 can be known devices that measure the R.P.M. of the respective metering means 40, 20, and 26, for example, by optical recognition, by inductance, or by other devices known to those of skill in the art.

The programmable control means 56 is preprogrammed to both monitor parameters and to control parameters in order to automatically operate the system so as to produce foam to specifications that are input by a system user at the keyboard of the programmer controller 56 or are pre-set by the system manufacturer. Specifically, the monitored parameters are the foam solution mixture temperature, the temperature of the surfactant, the air temperature, the air flow rate, the temperature of the fluid, the ambient air pressure, the pressure of the fluid at the exhaust port 22 of the first metering means 20, the pressure of the surfactant at the exhaust port 34 of the second metering means 26, the pressure of the foam at the compressor discharge port 46 of the air compressor 40, the ambient air humidity, and the quality of the produced foam with respect to electrical conductivity, and the measured RPM of the various metering means 20, 26, and 40. The parameters that are controlled by the programmable control means 56 include the R.P.M. of the various metering means 20, 26, and 40, the temperature of the surfactant, and the temperature of the foam solution mixture within the second fluid conduit 24.

In order to accomplish the monitoring and controlling of parameters of the foam producing system, the system further comprises several hardware mechanisms detailed below.

The first drive means control cable 61 enables the programmable control means 56 to both monitor and control the R.P.M. of the first drive means 60 and the flow rate of the fluid going into the system. Further, the fluid flow rate is controlled by the programmable control means 56 sending a signal to the first adjustable valve 52 via control cable 100, based upon pre-set and programmed instructions within the programmable control means 56. Similarly, the second drive means control cable 63 enables the programmable control means 56 to both monitor and control the R.P.M. of the second drive means 62 and the flow rate of the surfactant from surfactant source 30 into the system. Likewise, the surfactant going into the system is controlled by the programmable control means 56 sending a signal to the second adjustable valve 54 via control cable 102, based upon pre-set and programmed instructions within the programmable control means 56. Additionally, the air compressor drive means control cable 59 enables the programmable control means 56 to both monitor and control the R.P.M. of the air compressor drive means 58, and the pressure of the compressed air foam out of the system.

It is advantageous to quality foam production that the surfactant within the surfactant source 30 be pre-heated to a controlled temperature point. To do so, both a surfactant temperature sensing means 84 and a surfactant heating means 72 are provided within surfactant source 30. Thus, the temperature of the surfactant is monitored and controlled by the programmable control means 56 via surfactant temperature sensing means 84 through surfactant temperature control cable 70 using surfactant heating means 72.

In a variation of the third preferred embodiment, the water jacket heat sink 38 may be omitted from the relative portion of the second fluid conduit 24 encasing around the air compressor means 40. In place thereof (or alternatively, in addition thereto) is a foam solution mixture containing means 74 having therein a foam solution heating means 76 and a foam solution temperature sensing means 80, both of which are in communication with the programmable control means 56 via a foam solution temperature control cable 78 so as to respectively control and monitor the temperature of the foam solution that is to be injected into the air compressor means 40.

The fluid source 15 is also monitored for the fluid temperature therein using a fluid temperature sensing means 86 in communication with the programmable control means 56 via fluid temperature sensing mean control cable 92.

Atmospheric monitoring is also important to quality foam production. To this end, there are provided an air temperature/humidity/pressure sensing means 88 in communication with the programmable control means 56 via ambient air temperature/humidity/pressure sensing means control cable 90.

In order to have direct monitoring of both the exhaust pressure of the foam from the air compressor as well as the quality of the foam that is being produced by the system, monitoring means 96 is positioned in communication with the output of the air compressor means 40, which is in communication with the programmable control means 56 via monitoring means control cable 98. In one embodiment of the monitoring means 96, a combined pressure transducer (to monitor the output pressure thereat) and dual conductive electrodes (to monitor electrical conductivity of the output foam) are contained therein. By monitoring the electrical conductivity of the output foam, the quality or consistency of the foam being produced can be deduced, given that the type of fluid being used is a parameter that is input to the programmable control means 56 at the keyboard 57 by a system user, as well as other parameters. Thus, by so positioning the air compressor monitoring means 96 sequentially within the system after the air compressor means 40, the system is able to gauge, by this as well as other hardware techniques well known in the art, the output pressure and the electrical conductivity of the foam being produced.

As shown in FIGS. 1 through 3, most, if not all, of the control and monitoring cables (59, 61, 63, 64, 66, 70, 78, 90, 98, 100, 102, 132, 162, 166, and 174) for communication with the clutch means 160 or the programmable control means 56 can be within a wiring harness 82 routed to the programmable control means 56.

The programmable control means 56 performs both monitoring and controlling functions of the system according to a pre-programmed set of instructions. One example of the pre-programmed set of instructions, which performs a series of steps in the control and monitoring of the system, is shown in FIGS. 4 through 6.

Figure 4:
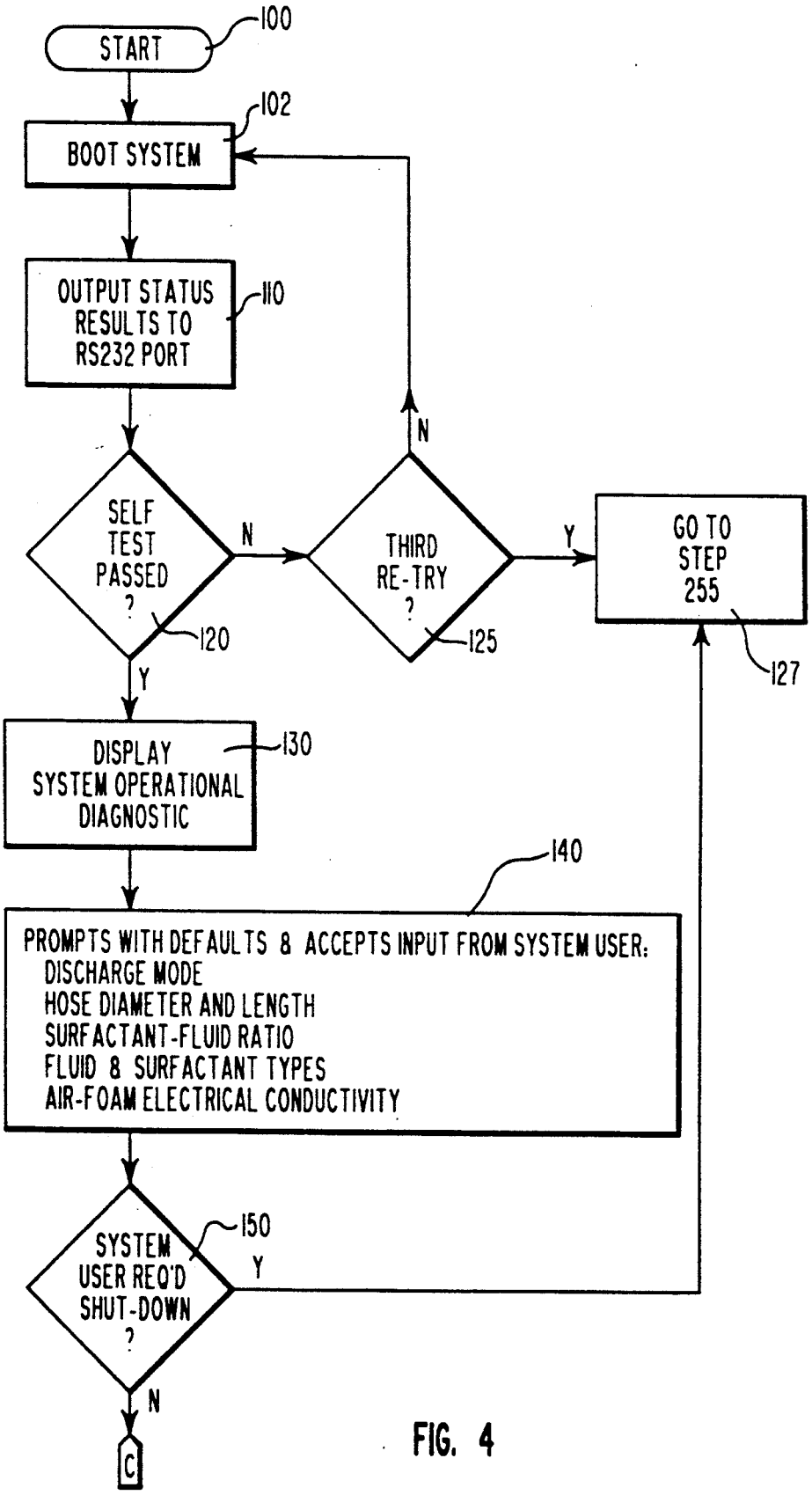
FIGS. 4 through 6 are flow charts illustrating a preferred embodiment of the logic steps for a programmable control means used by the third embodiment of the compressed air foam apparatus.

As shown in FIG. 4, step 100 is a starting step that is preferably initiated by a system user throwing a system start-up switch or a smoke or heat detector triggering such a switch. At step 102, the programmable control means 56 goes through an initial program load or 'boot' step. This step also includes such diagnostic routines as determining if all control leads in wire harness 82, and the devices to which they are attached, are in communication with the programmable control means 56. At step 110, the pass/fail status of the initialization step 102 is output to a communication port of the programmable control means 56 for subsequent display upon a display means 57 associated with the programmable control means 56. The status data output at step 110 is tested at step 120. If the start-up has failed three times, as indicated at step 125, the program will exit and move to shut down the system through step 255, as indicated at step 127, and then to termination at step 1000. Otherwise, the program will try to re-initialize at step 102 a maximum of three times. If the self-test at step 120 passes, control will move to step 130 where the display means 57 of the programmable control means will output a test-passed message to the system user.

At step 140, the system user is prompted upon the display means 57 for input, which may have pre-set default values, of operating parameters comprising: the orientation of the hose 48 as deck gun, vertical, up hill, level, or downhill; the hose diameter size; the hose length; a desired surfactant to fluid ratio; surfactant and fluid types; and a parameter representing desired foam quantity which is electrical conductivity of the foam to be produced. The input parameters are verified by look-up tables in the programmable control means 56. The system user may also choose to exit the system and shut the system down at this stage by inputting a pre-set response at step 150 which causes control to be passed to step 255 and then to termination at step 1000.

Figure 5:
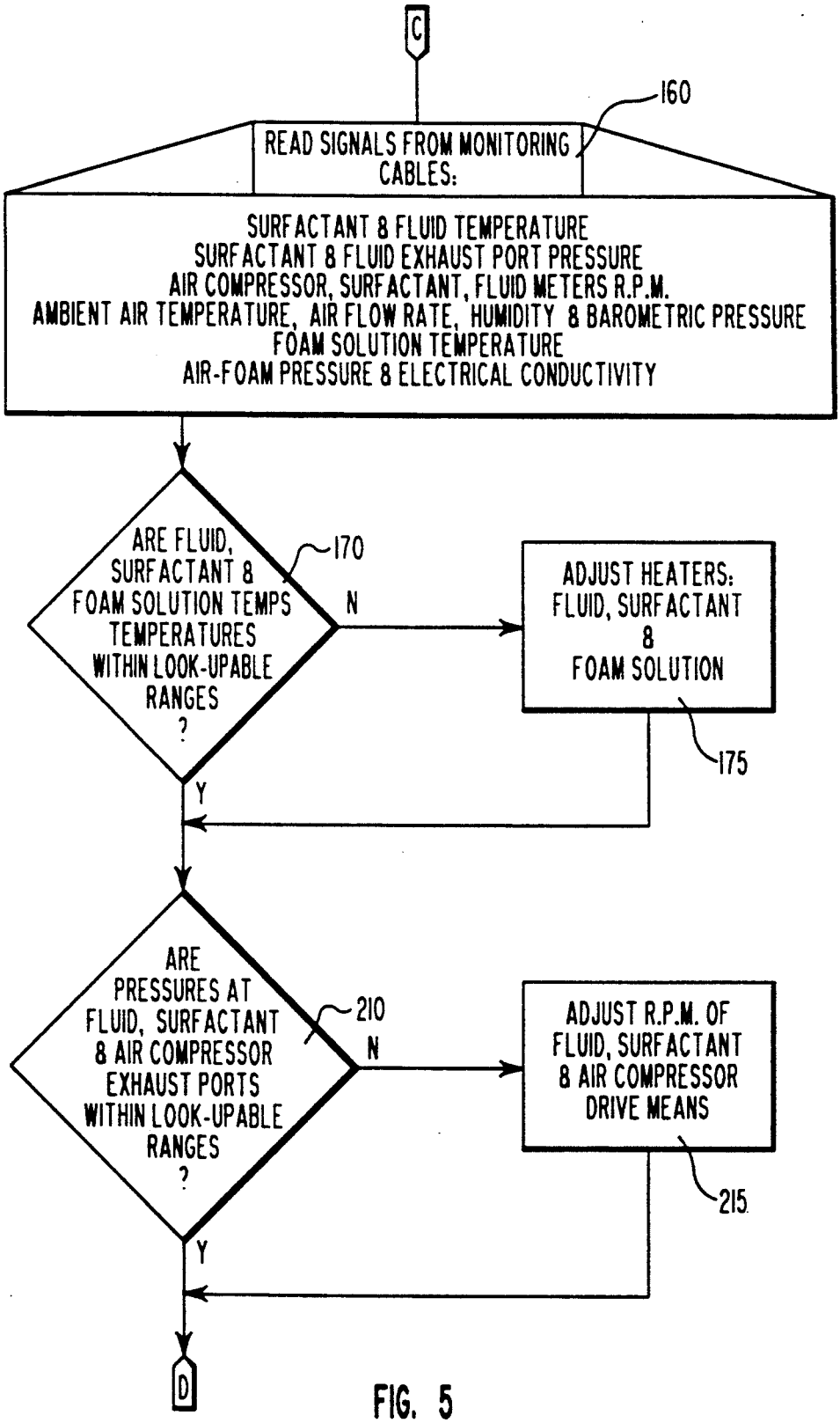
Figure 6:
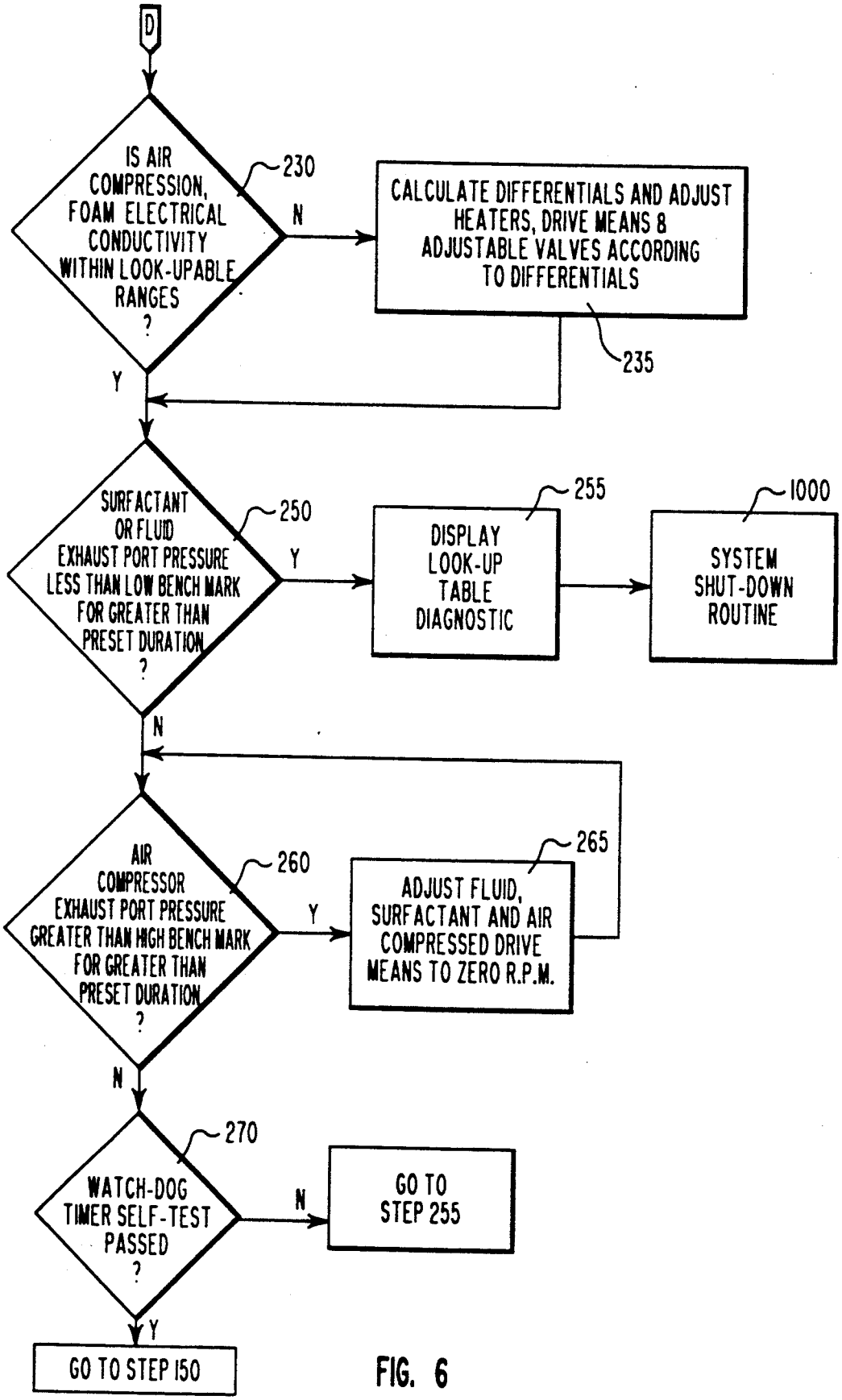

Should the system user choose to continue the system's operation (or the system is in a pre-set automatic control mode), in FIG. 5 control passes to step 160 where all the monitoring aspects of the system are tested to obtain current values. Specifically tested are the foam solution mixture temperature at 80, the temperature of the surfactant at 84, the air temperature at 88, the air flow rate at 91, the temperature of the fluid at 86, the ambient air pressure at 88, the pressure of the fluid at the exhaust port 22 of the first metering means 20, the pressure of the surfactant at the exhaust port 34 of the second metering means 26, the pressure of the compress-air foam at the exhaust port 46 of the air compressor means 40, the ambient air humidity at 88, the measured R.P.M. of all metering means including the air compressor means 40, the second metering means 26, and the fluid metering means 20, and the quality of the produced foam with respect to electrical conductivity at 96. The signals from the various monitoring means involved at step 160 may be transformed from analog signals into digital signals by a peripheral A-D means associated with the programmable control means 56 so as to arrive at discrete values.

After step 160, the instruction set passes on to step 170 where the resultant value of the temperature parameters, including fluid, surfactant, and foam solution are tested. If the temperature is not within a look-up table range, then appropriate adjustments are made at step 175 to the respective heaters 72, 76. Similarly, at step 210 in FIG. 5, the resultant value of the pressure parameters are tested, including fluid, surfactant, and air compressors at the respective exhaust ports. If respective detected pressure is not within a respective look-up table range, then appropriate adjustments are made at step 215 to the R.P.M. of the respective drive means 58, 60, 62.

In FIG. 6, the electrical conductivity of the compressed air foam, as measured at 96 is looked-up against the input at step 140 and against a look-up table, as indicated at step 230. If there is a need, as indicated from the look-up, differentials are calculated and the appropriate adjustments derived therefrom are computed at step 235. The adjustments derived by the instruction in the programmable control means 56 may be adjustments to the adjustable valves 52, 54, the heaters 72, 76, and/or the drive means 58, 60, 62.

At step 250, if the fluid pressure detected at either of the exhaust ports 22, 34 is less than a pre-set pressure for a pre-set duration, a diagnostic at step 255 will display upon display means 57 (e.g. "Low Fluid Pressure" or "low Surfactant Pressure") and the system will shut down by the routine at step 1000.

At step 260, the system determines if a system user has closed off the flow of foam out of the discharge device. Such as condition is indicated by a higher than a pre-set pressure detected at the exhaust port 46 of the air compressor means 40. If such a pressure is detected at step 260, drive means 58, 60, and 62 are adjusted to zero R.P.M, as indicated at step 265, until the pressure drops below the pre-set maximum pressure and the system resumes producing foam at step 260. A general house-keeping diagnostic routine is performed at step 270 to check for problems in the programmable control means 56 operational capability, and if it has a failure, the system shuts down through a diagnostic display at step 255. Otherwise, the program re-cycles through step 150 in FIG. 4, as above.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A compressed air foam pump apparatus comprising:

(a) a drive means for cyclically driving a power transmission means;

(b) a means for delivering a fluid from a fluid source to a first fluid conduit;

(c) a first metering means, driven by said power transmission means, for metering a predetermined volume of said fluid with each cycle of said power transmission means, and comprising:

a first meter injection port, in fluid communication with the first fluid conduit, for introducing said fluid to the first metering means;

a first meter discharge port; and a second fluid conduit in fluid communication with the first meter discharge port, into which said predetermined volume of fluid is discharged from the first metering means;

(d) a second metering means, driven by said power transmission means, for metering a predetermined volume of a foaming agent surfactant from a foaming agent surfactant source with each cycle of the power transmission means, and comprising:

a second meter injection port;

a foaming agent conduit, in fluid communication with both the second meter injection port and the foaming agent surfactant source, for introducing said foaming agent surfactant to the second metering means; and a second meter discharge port, in fluid communication with said second fluid conduit, through which said predetermined volume of foaming agent surfactant is discharged into said second fluid conduit, whereby said discharged predetermined volumes of foaming agent surfactant and fluid are mixed within said second fluid conduit to produce a foam solution mixture;

(e) an air compressor means, driven by said power transmission means, for metering, mixing, compressing and discharging both a predetermined volume of said foam solution mixture and a predetermined volume of air with each cycle of said power transmission means to produce an air-foam mixture, the air compressor means comprising:

at least one air inlet port for supplying air to the air compressor means;

a compressor injection port in fluid communication with said second fluid conduit for delivering said foam solution mixture to the air compressor means; and a compressor discharge port through which the air-foam mixture is discharged from the air compressor means, a portion of said second fluid conduit comprising a heat sink that is in contact with said air compressor means, whereby heat generated by said air compressor means is transferred to the foam solution mixture within said second fluid conduit.

2. An apparatus as recited in claim 1 wherein at least one of said first and second metering means is a rotary vane pump.

3. An apparatus as recited in claim 1 wherein said power transmission means is a drive shaft.

4. An apparatus as recited in claim 1 wherein said air compressor means is a rotary vane pump compressor.

5. An apparatus as recited in claim 1 further comprising a first adjustable valve means, disposed between said first meter discharge port and the second fluid conduit, for shunting a portion of said predetermined volume of said fluid from discharge into said second fluid conduit.

6. An apparatus as recited in claim 5 wherein said first adjustable valve means further comprises a means for returning said shunted portion to said fluid source.

7. An apparatus as recited in claim 5 further comprising a second adjustable valve means, disposed between said second meter discharge port and the second fluid conduit, for shunting a portion of said predetermined volume of said conduit.

8. An apparatus as recited in claim 7 further wherein said second adjustable valve means further comprises a means for returning said shunted portion to the foaming agent surfactant source.

9. An apparatus as recited in claim 7 wherein said first adjustable valve means and said second adjustable valve means are each electrically adjustable in relation to the varying of an electrical valve drive signal supplied thereto.

10. An apparatus as recited in claim 9 further comprising a control means, electrically connected to the first and the second adjustable valve means, for independently adjusting said first and said second adjustable valve means by generating said electrical valve drive signal.

11. An apparatus as recited in claim 10 wherein said control means further comprises a microprocessor, an analog to digital convertor, a digital to analog convertor, and a user interface having an input means, whereby a user inputs to said input means of the user interface to control said control means and thereby adjust said first and second adjustable valve means.

12. An apparatus as recited in claim 1 further comprising:

a first pressure sensor for sensing the pressure of the discharged fluid at the first meter discharge port and for generating a signal in proportion thereto;

a second pressure sensor for sensing the pressure of the discharged foaming agent surfactant at the second meter discharge port and for generating a signal in proportion thereto;

a third pressure sensor for sensing the pressure of the discharged air-foam mixture at the compressor discharge port and for generating a signal in proportion thereto;

drive control means for controlling the drive to said power transmission means from said drive means;

each said first, second and third pressure sensor transmitting said signal therefrom to said drive control means;

whereby the drive to said power transmission means is controlled by said drive control means as a function of the respective signals from said first, second and third pressure sensors.

13. An apparatus as recited in claim 12 wherein said drive control means for controlling the drive to said power transmission means from said drive means is a clutch.

14. An apparatus as recited in claim 13 wherein the signal transmitted from each said first, second and third pressure sensor to said clutch is pneumatic.

15. An apparatus as recited in claim 1 wherein said predetermined volume of said foaming agent surfactant is approximately one percent of said predetermined volume of said fluid, and wherein said air-foam mixture comprises approximately one cubic foot of air to approximately one gallon of said fluid.

16. A compressed air foam pump apparatus comprising:

(a) means for delivering a fluid from a fluid source to a first fluid conduit;

(b) first and second metering means, each being operable at a plurality of metering speeds, for respectively metering therefrom said fluid and a foaming agent surfactant proportional to the respective metering speeds thereof, said first metering means comprising:

a first meter injection port, in fluid communication with the first fluid conduit, for introducing said fluid to the first metering means;

a first meter discharge port; and a second fluid conduit, in fluid communication with the first meter discharge port, into which said predetermined volume of fluid is discharged from the first metering means;

(c) a foaming agent conduit, in fluid communication with both a second meter injection port and a foaming agent surfactant source, (d) said second metering means comprising:

the second meter injection port in fluid communication with the foaming agent conduit, for introducing said foaming agent surfactant to the second metering means; and a second meter discharge port, in fluid communication with said second fluid conduit, through which said foaming agent surfactant is discharged into said second fluid conduit, whereby both said foaming agent surfactant and said fluid discharged within said second fluid conduit are mixed therein to produce a foam solution mixture;

(e) an air conduit, in fluid communication with both the second fluid conduit and an air source, (f) an air compressor means, operable at a plurality of metering speeds, for metering, mixing, compressing and discharging therefrom, proportional to the metering speed thereof, both air and said foam solution mixture to produce an air-foam mixture, the air compressor means comprising:

a compressor injection port in fluid communication with said second fluid conduit for receiving therefrom both said foam solution mixture and said air to the air compressor means; and a compressor discharge port for discharging therefrom said produced air-foam mixture;

(g) first, second, and third drive means for respectively driving the first and second metering means and the air compressor means, the respective operating speed of the first and second metering means and the air compressor means being proportional to respective electrical first, second and third motor drive signals supplied thereto; and (h) programmable control means comprising a program memory means, electrically connected to the first, the second and the third drive means, for independently setting the respective operating speeds of the first and second metering means and the air compressor means by respectively generating said first, second and third motor drive signals according to a preprogrammed instruction set stored in said programmable memory means.

17. An apparatus as recited in claim 16 wherein a portion of said second fluid conduit comprises a heat sink that is in contact with said air compressor means, whereby heat generated by said air compressor means is transferred to the foam solution mixture within said second fluid conduit.

18. An apparatus as recited in claim 16 wherein at least one of said first and second metering means is a rotary vane pump.

19. An apparatus as recited in claim 16 wherein said air compressor means is a rotary vane pump compressor.

20. An apparatus as recited in claim 16 further comprising a first adjustable valve means, disposed between said first meter discharge port and said second fluid conduit, for shunting a portion of the fluid discharged from the first meter discharge port from entry into said second fluid conduit.

21. An apparatus as recited in claim 20 wherein said first adjustable valve means further comprises a means for returning said shunted portion of said fluid to said fluid source.

22. An apparatus as recited in claim 20 further comprising a second adjustable valve means, disposed between said second meter discharge port and said second fluid conduit, for shunting a portion of the foaming agent surfactant discharged from the second meter discharge port from entry into said second fluid conduit.

23. An apparatus as recited in claim 22 further wherein said second adjustable valve means further comprises a means for returning said shunted portion of said foaming agent surfactant to the foaming agent surfactant source.

24. An apparatus as recited in claim 22 wherein both said first and second adjustable valve means are electrically connected to said programmable control means and are electrically adjustable in relation to respective generated electrical valve drive signals supplied thereto from said programmable control means, said programmable control means independently adjusting said first and said second adjustable valve means by said generated electrical valve drive signals according to said preprogrammed instruction set stored in said programmable memory means.

25. An apparatus as recited in claim 16 further comprising:

a first pressure sensor for sensing the pressure of the discharged fluid at the first meter discharge port and for generating a signal in proportion thereto;

a second pressure sensor for sensing the pressure of the discharged foaming agent surfactant at the second meter discharge port and for generating a signal in proportion thereto;

a third pressure sensor for sensing the pressure of the discharged air-foam mixture at the compressor discharge port and for generating a signal in proportion thereto;

the first, second and third pressure sensors each being electrically connected to and each inputting said generated signals therefrom to the programmable control means;

said programmable control means independently setting the operating speeds of the first, the second and the third drive means by generating said first, said second and said third motor drive signals according to said preprogrammed instruction set stored in said programmable memory means as a function of said generated first, second and third pressure sensor signals.

26. An apparatus as recited in claim 16 further comprising:

a foam solution mixture heating means for heating the foam solution mixture in the second fluid conduit; and a foam solution mixture temperature sensor for sensing the temperature of the foam solution mixture in the second fluid conduit, both said foam solution mixture sensor and said foam solution mixture heating means being in electrical communication with said programmable control means, said foam solution mixture temperature sensor inputting to the programmable control means a signal proportional to the temperature of the foam solution mixture sensed in the second fluid conduit and the programmable control means generating and inputting to the foam solution mixture heating means a control signal according to said preprogrammed instruction set stored in said program memory means as a function of said proportional signal from said foam solution mixture temperature sensor, whereby the temperature of the foam solution mixture in said second fluid conduit is controlled by said programmable control means.

27. An apparatus as recited in claim 16 further comprising:

a foaming agent surfactant heating means for heating the foaming agent surfactant in the foaming agent surfactant source; and a foaming agent surfactant temperature sensor for sensing the temperature of the foaming agent surfactant in the foaming agent surfactant source, both said foaming agent surfactant heating means and said a foaming agent surfactant temperature sensor being in electrical communication with said programmable control means, said foaming agent surfactant temperature sensor inputting to the programmable control means a signal proportional to the temperature of the foaming agent surfactant in the foaming agent surfactant source and the programmable control means generating and inputting to the foaming agent surfactant heating means a control signal according to said preprogrammed instruction set stored in said program memory means as a function of said proportional signal from said foaming agent surfactant temperature sensor, whereby the temperature of the foaming agent surfactant in said foaming agent surfactant source is controlled by said programmable control means.

28. An apparatus as recited in claim 16 further comprising:

first, second and third tachometer means in electrical connection to both said programmable control means and respective first, second and third drive means, for respectively sensing the operating speeds of the first, the second and the third drive means, for respectively generating therefrom first, second, and third tachometer signals proportional to said respective operating speeds, and for inputting said first, second, and third tachometer signals to said programmable control means, to enable said programmable control means to respectively generate said first, second and third motor drive signals according to said preprogrammed instruction set stored in said programmable memory means as a function of said first, second, and third tachometer signals.

29. An apparatus as recited in claim 16 further comprising:

an electrical conductivity sensor means for sensing the electrical conductivity of the air-foam mixture discharged from the air compressor means, for generating a signal proportional to the sensed electrical conductivity thereof, and for inputting said proportional electrical conductivity signal to said programmable control means, the programmable control means generating said first, second and third motor drive signals according to said preprogrammed instruction set stored in said programmable memory means as a function of said electrical conductivity signal.

30. An apparatus as recited in claim 16 further comprising:

a means for sensing the ambient air for the humidity, the barometric pressure, and the temperature thereof, for respectively generating proportional thereto a humidity signal, a barometric pressure signal, and a temperature signal, and for inputting the signals generated therefrom to said programmable control means, the programmable control means generating said first, second and third motor drive signals according to said preprogrammed instruction set stored in said programmable memory means as a function of said humidity signal, barometric pressure signal, and temperature signal.

31. An apparatus as recited in claim 16 further comprising an air flow sensor means for sensing air flow in the air conduit, for generating a signal proportional to the sensed air flow, and for inputting said proportional air flow signal to said programmable control means, the programmable control means generating said third motor drive signal according to said preprogrammed instruction set stored in said programmable memory means as a function of said proportional air flow signal.

32. An apparatus as recited in claim 16 wherein said programmable control means further comprises a user interface comprising an input means for receiving input from a system user, said input comprising a hose discharge mode parameter, a hose diameter parameter, a hose length parameter, a surfactant-fluid ratio parameter, a fluid type parameter, a surfactant type parameter, and an air-foam electrical conductivity parameter, the programmable control means generating said first, second and third motor drive signals according to said preprogrammed instruction set stored in said programmable memory means as a function of the parameters of said input received at said input means from said system user.

33. An apparatus as recited in claim 32 wherein the user interface further comprises a display means for displaying at least one abnormal operating indicator and an alphanumeric display, said display means being controlled according to said preprogrammed instruction set stored in said programmable memory means.

34. An apparatus as recited in claim 16 wherein said predetermined volume of said foaming agent surfactant is approximately one percent of said predetermined volume of said fluid, and wherein said air-foam mixture comprises approximately one cubic foot of air to approximately one gallon of said fluid.

35. A method for producing a compressed air foam comprising the steps of:

(a) driving a power transmission means cyclically with a drive means;

(b) driving first and second metering means and an air compressor means, each respectively having an injection port and a discharge port, with said cyclically driven power transmission means;

(c) supplying a fluid from a fluid source to a first fluid conduit;

(d) metering a predetermined volume of said fluid in the first fluid conduit through said injection port of said first metering means with each cycle of said power transmission means;

(e) discharging said predetermined volume of said fluid from said discharge port of said first meter means into a second fluid conduit with each cycle of said power transmission means;

(f) supplying a foaming agent surfactant from a foaming agent surfactant source to a foaming agent surfactant conduit;

(g) metering a predetermined volume of said foaming agent surfactant in the foaming agent surfactant conduit through said injection port of said second metering means with each cycle of said power transmission means;

(h) discharging said predetermined volume of said foaming agent surfactant from said discharge port of said second metering means into said second fluid conduit with each cycle of said power transmission means, whereby both said discharged predetermined volumes of foaming agent surfactant and fluid are mixed within said second fluid conduit to produce therein a foam solution mixture;

(i) supplying air to said injection port of said air compressor means;

(j) supplying foam solution mixture in said second fluid conduit to a portion of said second fluid conduit comprising a heat sink that is in contact with said air compressor means, whereby heat generated by said air compressor means is transferred to the foam solution mixture within said second fluid conduit;

(k) supplying foam solution from said heat sink to said injection port of said air compressor means;

(l) metering both a predetermined volume of air and a predetermined volume of said foam solution mixture into said injection port of said air compressor means with each cycle of said power transmission means;

(m) mixing and compressing both said predetermined volume of air and said predetermined volume of said foam solution mixture within said air compressor means to produce and air-foam mixture; and (n) discharging said air-foam mixture from said discharge port of said air compressor means with each cycle of said power transmission means.

36. A method as defined in claim 35 wherein said predetermined volume of said foaming agent surfactant is approximately one percent of said predetermined volume of said fluid, and wherein said air-foam mixture comprises approximately one cubic foot of air to approximately one gallon of said fluid.

37. A method for producing a compressed air foam comprising the steps of:

(a) driving first and second metering means and an air compressor means, each respectively having an injection port and a discharge port, respectively with first, second, and third drive means, the respective operating speed of the first, second, and third drive means being proportional to respective electrical first, second, and third motor drive signals supplied thereto;

(b) monitoring and controlling said first, second and third drive means with a programmable control means comprising a program memory means, electrically connected to the first, second and third drive means, for independently setting the operating speeds thereof by respectively generating said first, second and third motor drive signals according to a preprogrammed instruction set stored in said program memory means;

(c) supplying a fluid from a fluid source to a first fluid conduit;

(d) metering a predetermined volume of said fluid in the first fluid conduit through said injection port of said first metering means;

(e) discharging said predetermined volume of said fluid from said discharge port of said first meter means into a second fluid conduit;

(f) supplying a foaming agent surfactant from a foaming agent surfactant source to a foaming agent surfactant conduit;

(g) metering a predetermined volume of said foaming agent surfactant in the foaming agent surfactant conduit through said injection port of said second metering means;

(h) discharging said predetermined volumes of said foaming agent surfactant from said discharge port of said second metering means into said second fluid conduit, whereby both said discharged predetermined volumes of foaming agent surfactant and fluid are mixed within said second fluid conduit to produce therein a foam solution mixture;

(i) supplying air to said injection port of said air compressor means;

(j) supplying foam solution mixture in said second fluid conduit to said injection port of said air compressor means;

(k) metering both a predetermined volume of air and a predetermined volume of said foam solution mixture into said injection port of said air compressor means;

(l) mixing and compressing both said predetermined volume of air and said predetermined volume of said foam solution mixture within said air compressor means to produce an air-foam mixture; and (m) discharging said air-foam mixture from said discharge port of said air compressor means.

38. A method as defined in claim 37 wherein said predetermined volume of said foaming agent surfactant is approximately one percent of said predetermined volume of said fluid, and wherein said air-foam mixture comprises approximately one cubic foot of air to approximately one gallon of said fluid.

* * * * *